US008731848B2

(12) United States Patent
Jones et al.

(10) Patent No.: US 8,731,848 B2
(45) Date of Patent: May 20, 2014

(54) MONITORING FLOW OF SINGLE OR MULTIPLE PHASE FLUIDS

(75) Inventors: Christopher M. Jones, Houston, TX (US); Anthony H. van Zuilekom, Houston, TX (US); Michael T. Pelletier, Houston, TX (US); Mark A. Proett, Houston, TX (US); Robert Atkinson, Richmond, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 691 days.

(21) Appl. No.: 12/895,080

(22) Filed: Sep. 30, 2010

(65) Prior Publication Data

US 2012/0084021 A1 Apr. 5, 2012

(51) Int. Cl.
*G01F 1/00* (2006.01)

(52) U.S. Cl.
USPC ..... 702/45; 702/12; 702/50; 702/100

(58) Field of Classification Search
USPC ..... 702/12, 45, 50, 100; 700/285; 73/53.04, 73/152.18, 152.29
See application file for complete search history.

(56) References Cited

U.S. PATENT DOCUMENTS 4,733,232 A * 3/1988 Grosso ..... 367/82
4,802,144 A 1/1989 Holzhausen et al.
7,551,516 B2 * 6/2009 Harmon ..... 367/25

* cited by examiner

*Primary Examiner* — Elias Desta
(74) *Attorney, Agent, or Firm* — Schwegman, Lundberg & Woessner, P.A.; Holly Soehnge

(57) ABSTRACT

Various embodiments include apparatus and methods to monitor flow of single and multiple phase fluids. Sensors of a tool can be dispersed along the tool to collect measurements to be processed using an autocorrelation operation on the collected measurements to provide information relative to the phases of the fluid. Additional apparatus, systems, and methods are disclosed.

20 Claims, 5 Drawing Sheets

MONITORING FLOW OF SINGLE OR MULTIPLE PHASE FLUIDS

TECHNICAL FIELD

The invention relates generally to systems having well logging capability.

BACKGROUND

In drilling wells for oil and gas exploration, understanding the structure and properties of the geological formation surrounding a borehole provides information to aid such exploration. However, the environment in which the drilling tools operate is at significant distances below the surface and measurements to manage operation of such equipment are made at these locations. Further, the usefulness of such measurements may be related to the precision or quality of the information derived from such measurements.

BRIEF DESCRIPTION OF THE DRAWINGS

Embodiments of the invention are illustrated by way of example and not limitation in the figures of the accompanying drawings in which.

DETAILED DESCRIPTION

The following detailed description refers to the accompanying drawings that show, by way of illustration, various example embodiments of the invention. These embodiments are described in sufficient detail to enable those skilled in the art to practice these and other embodiments. Other embodiments may be utilized, and structural, logical, and electrical changes may be made to these embodiments. The various embodiments are not necessarily mutually exclusive, as some embodiments can be combined with one or more other embodiments to form new embodiments. The following detailed description and accompanying drawings are, therefore, not to be taken in a limiting sense.

Figure 1:
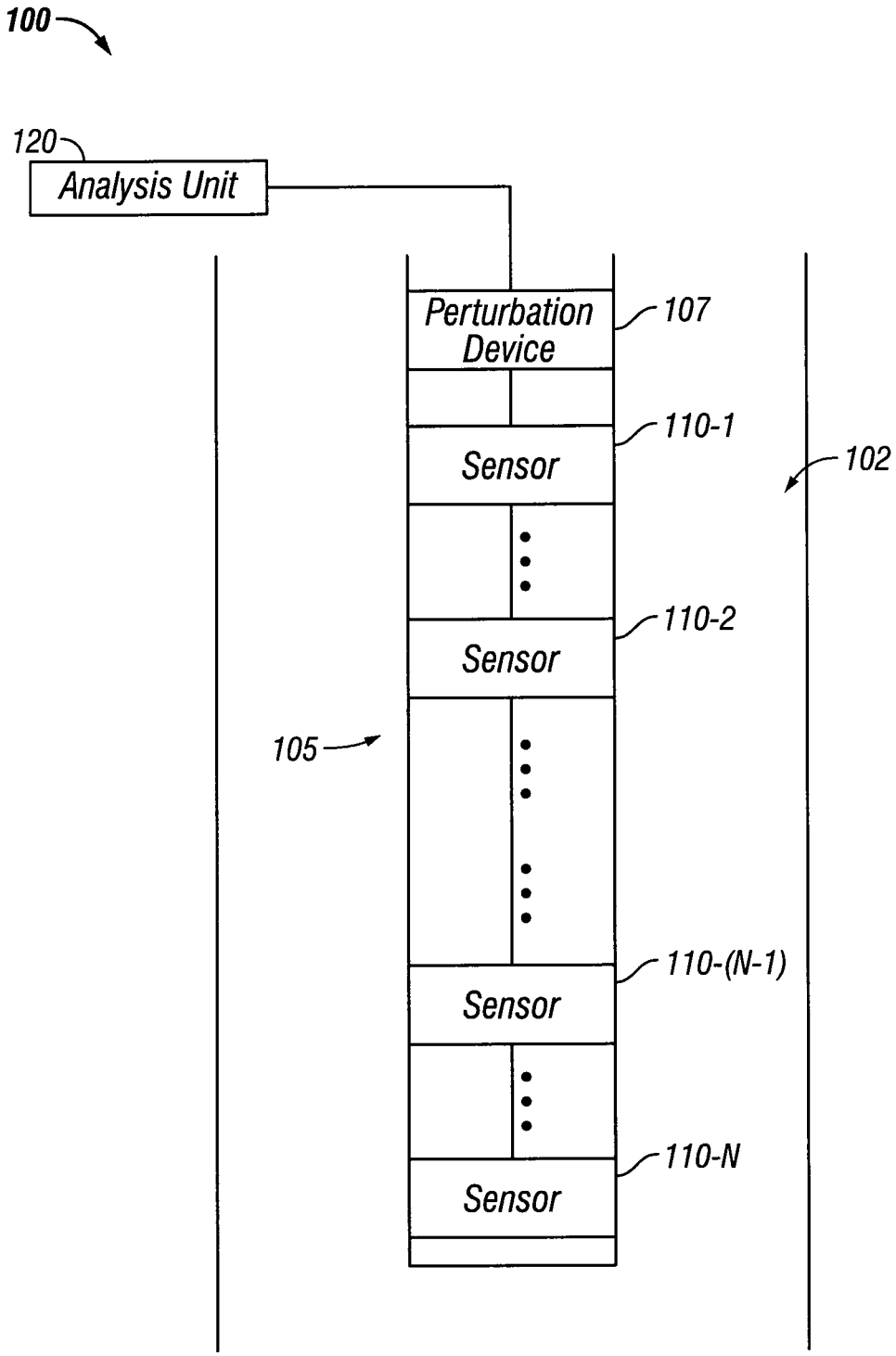
FIG. 1 shows a block diagram of an example of a measurement system operable in a borehole to collect measurements in a fluid flow, according to various embodiments.

FIG. 1 shows a block diagram of an example embodiment of a measurement system 100 operable in a borehole 102 to collect measurements in a fluid flow. Measurement system 100 includes a tool 105 and an analysis unit 120. Tool 105 has a plurality of sensors 110-1, 110-1 . . . 110-(N−1), 110-N dispersed along tool 105. The plurality of sensors 110-1, 110-1 . . . 110-(N−1), 110-N include sensors such that, in one or more combinations, the sensors are sensitive to all phases of the fluid in the flow. By sensitive to all phases of the fluid, it is meant that that the phases are present in sufficient amount to be measureable by one or more of sensors 110-1, 110-1 . . . 110-(N−1), 110-N.

Analysis unit 120 can be configured to perform an autocorrelation operation on the collected measurements such that a factor of fluctuation per unit time is matched to each respective phase of the fluid. Analysis unit 120 can include a processor and a machine-readable storage medium having instructions stored thereon, which when executed by the processor, cause measurement system 100 to perform a number operations. The operations can include operations to determine a property of a phase of the fluid based on results from performing the autocorrelation operation. Properties determined based on results from performing the autocorrelation operation can include one or more of a volumetric flow rate of the phase, a mass flow rate of the phase, or other properties of the phase derivable from the volumetric flow rate and/or the mass flow rate. The autocorrelation operation on the collected measurements can use one or more techniques such as, but not limited to, time evolved factor analysis, general autocorrelation, multivariate curve resolution, histogram profiling, or other similar evaluation process.

Tool 105 and analysis unit 120 can be configured to be operable in various measurement configurations such as in a wireline system or in a measurements-while-drilling (MWD) system such as a logging-while-drilling (LWD) system. In addition, measurement system 100 may optionally include a fluid stream perturbing device 107. Fluid stream perturbing device 107 can be disposed relative to sensors 110-1, 110-1 . . . 110-(N−1), 110-N such that the fluid stream perturbing device 107 is operatively upstream relative to the flow of the fluid pass sensors 110-1, 110-1 . . . 110-(N−1), 110-N. With the autocorrelation operation based on variations or fluctuations in the phases of the fluid over time, phases that are consistent over distance or mildly grading in composition and properties may be insensitive to the autocorrelation technique for determining flow rates of the phases. Fluid stream perturbing device 107 can inject a perturbation upstream of the sensors 110-1, 110-1 . . . 110-(N−1), 110-N relative to a phase of the fluid, when the phase is flowing without sufficient variation at the respective measuring sensors absent the perturbation.

Though, in various embodiments, designs may include a fluid stream perturbing device configured to be placed upstream of multiple fluid sensors, natural perturbing instances may occur in the flow such that use of the fluid stream perturbing device may be reduced or eliminated in measurements. Examples of natural perturbing instances include, but are not limited to flow around the bend of an elbow, flow at a reducing or enlarging union, induction of a gas bubble, a change from laminar flow to turbulent flow, or other similar activities that accompany a change in flow. The arrangement of sensors and the evaluation of their measurements use perturbation that is observable by the fluid sensors employed.

For instance, if an optical fluid sensor is employed, a perturbation may be induction of a gas bubble, a change from laminar flow to turbulent flow, or injection of an absorbing or fluorescing dye. A single perturbation most likely affects different phases differently. However, in the case that a perturbation does not affect a given phase at all, multiple perturbations (one for each independent phase) may be induced. Relative perturbations may be induced in the case that an absolute perturbation provides less than sufficient delineating characterization. For instance with an optical sensor, two dies may simultaneously be injected in different concentrations to induce a relative optical density ratio between two different optical band centers. Perturbations may also be varied temporally with characteristic frequencies, beats, or cords so as to lock the pattern. Many natural perturbations occur with regular frequency that can provide the measurable perturbations without inducing a perturbation using a perturbation injection device.

With known distance between multiple sensors and/or the perturbation point, an autocorrelation function of sensor responses can yield a linear velocity for each phase observed. This autocorrelation function may make use of various algorithms to perform an autocorrelation operation. Such autocorrelation algorithms may include, but are not limited to, time evolved factor analysis, general autocorrelation, multivariate curve resolution, or histogram profiling. To convert the linear flow, provided by the autocorrelation analysis of the data from the sensors, into volumetric flow, the fluid phase cross section can be determined at the sensor points. To convert the linear flow into volumetric flow, an average phase volume, determined for the regions near the sensors, can be determined with volume based sensors such as optical analyzers. Alternatively, mass based sensors may be used to determine mass flow. Mass flow and volumetric flow may be interconverted with known phase densities. Alternatively, if mass flow and volumetric flow are determined, then phase densities may be calculated. In addition, phase compressibility may be derived from sensors placed at points of differing pressures, or from flow velocities correlated over differing pressures, if phase velocities are known.

As fluid moves through a tool implemented with respect to drilling operations, there are several different conditions changing. Such changing conditions can include changing temperature, changing pressure, changing fluid density as the pressure changes, and other changing conditions. These changes can be accompanied with the pumping of a variety of different fluids through the tool at a particular rate. However, the rate of pumping may not actually be the same as the rate the fluid is leaving the tool for a single phase fluid. In addition, different phases of a multiphase fluid can be flowing through the tool at different rates with respect to each over and at different rates relative to the selected pump rate.

In an example measurement situation, a tool touches the wall of a well bore and fluid is withdrawn into the tool. The fluid that is in the well bore is at a higher hydrostatic pressure than the core pressure of the formation and there is a general pressure grading when trying to pump filtrate into the formation. Filtrate is the liquid portion of the slurry, which is referred to as drilling mud. To bring fluid into the tool, suction is created for the internal plumbing of the tool to withdraw fluid first from the mud cake, out of the formation, and bring it up into the tool. There is a pressure change, since the formation was initially broached by the well, associated with filtrate being pushed out into the system. As the material is drawn into the tool, there may be a compositional gradient that starts with the filtrate. The compositional gradient moves to a mixture of reservoir fluids and, at some time after pulling in the material, the collected material may be identifiable as original reservoir fluid. However, the reservoir fluid can be an oil, a gas, a water based material, or combinations thereof. Though an ideal objective would be to have a single phase material, as fluid is withdrawn into the tool, changes in composition are observed because of the filtrate gradient. Other observed changes include changes in terms of temperature, since the well drilling process has been circulating mud from surface temperature to the down hole temperature, including extracting heat. As a result of these changes, there can be many gradients in the measurement system. The longer that fluid is pumped into the tool, more gradients and asymptotes of the gradients are going to be observed. At some point in time, a steady state of filtrate may be attained providing an increased quantity of reservoir fluid such that the temperature of the material coming into the tool would be sufficiently close to the reservoir temperature at some distance from where it was perturbed.

The phases of a multiphase fluid can occur in different forms. In addition to a gas and a liquid, there can be a liquid/liquid system. There can be an oil phase having a gas saturation within it. There can be an aqueous phase with gas dissolved in it. Solid particles may float in the fluid system.

A temperature sensor responds differently in a heat transfer manner with respect to gas or liquid. Within a fluid, one phase may carry more heat than another phase. Each individual phase has a different heat capacity, which indicates the amount of thermal energy that can be absorbed for a change in temperature, such that the temperature of the multiphase fluid is driven by the heat capacity of the individual phases in the fluid. For a fluid, a temperature sensor at one location may have observed temperature fluctuations that may be similar to temperature fluctuations at another temperature sensor downstream. This allows for the correlation of pulses in the temperature of the flowing fluid over a unit of time over unit length, which provides a mechanism for a flow meter.

In addition, it can be noted that not only can temperate data be observed to fluctuate as a phase passes by sensors separate over some distance, other data can be observed to fluctuate. Fluctuations in capacity, resistivity, and density can be observed in different sensors fluctuating as the phases pass by them. In an arrangement with a number of different sensors, these different sensors observe fluctuating in these different phases in the multiphase fluid, where some of the sensors are more sensitive to one phase than another. For instance, a resistivity sensor may be more sensitive to the water phase than other phases such as oil or gas. A density sensor may be sensitive to the density contrast between the phases. A capacitance sensor may provide an overall average flowing fraction being the phases. These different property observations use multiple different types of sensors distributed throughout a measurement tool, all of which respond very differently to different phases, and observe different phases differently. In addition, there can be a transverse dispersion function operative relative to the different properties of the different phases.

A transverse dispersion function takes into account changes in phases at cross-sections of the flow fluid due to the interaction between the phases of the fluid. These interactions may be viewed as one or more phases of a fluid pulling on and providing forces to other phases of the fluid in the flow such that changes in cross section of the phases in the fluid flow may occur. Such changes may occur between the various sensors of the tool as the fluid passes. The transverse dispersion function characterizes the mixing of the phases along the fluid flow from an initial mixing location. In various embodiments, the mixing can be characterized by a linear function in the flow direction away from the place of initial mixing. The transverse dispersion function may be applied to provide target models of the fluid flow to be observed at the sensors following the initial sensor. The transverse dispersion function may be applied in an iterative process for application of the autocorrelation operation with respect to the sensors.

In various embodiments, an autocorrelation operation can be applied to signals from a number of sensors dispersed across the flow measurement tool. Using autocorrelation on the data collected on the fluid flow as it passes the sensors distributed across the tool, factors that fluctuate across unit time can be generated, where the number of factors identifies the number of phases in the multiphase fluid. The autocorrelation operations provide a mechanism to look at variations across the sensors. An example of an autocorrelation operation can be realized by application of a time evolved factor analysis. In the time evolved factor analysis, each of the sensors can be considered to be a different channel. An auto correlation function provided by the time evolved factor analysis provides a technique designed to match factors with factors of fluctuation across unit time. In a time evolved factor analysis system, a number of different factors may be determined, for example, two different factors or three different factors. These factors are equivalent to the number of phases of the fluid. The factor fluctuation per unit time can yield a flow rate for these different phases. If distance is known, such a flow rate can be calculated as a volumetric flow rate. With known densities of the composition of the fluid, the factor fluctuation per unit time can yield a flow rate that translates to mass. In such an analysis, the number of sensors dispersed throughout the system such that they are sensitive to the different phases in the fluid. A combination of sensors, which yield enough to degrees of freedom to physically provide the data of the different phases, can be used such that each sensor need not be sensitive to all phases.

Figure 2:
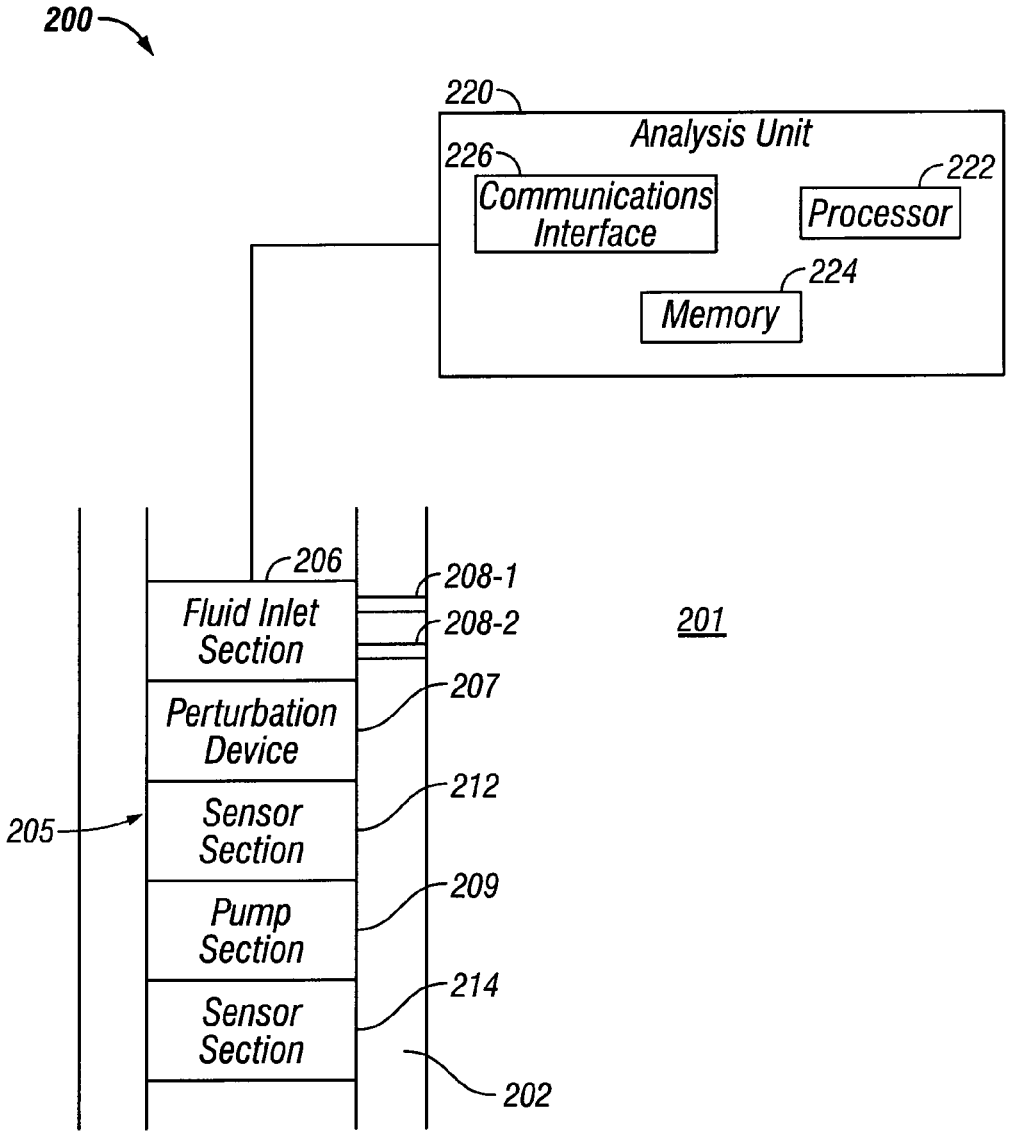
FIG. 2 shows a block diagram of an example measurement apparatus including a tool and an analysis unit operable in a borehole, according to various embodiments.

FIG. 2 shows an example embodiment of a measurement apparatus 200 including a tool 205 and an analysis unit 220 operable in a borehole 202. Tool 205 includes a fluid inlet section 206 that can draw in fluid from a formation 201 using probes 208-1 and 208-2 that can be arranged to contact formation 201. The number of probes to draw in the fluid can range from one to any number greater than one depending on the particular situation in which tool 205 is applied. Tool 205 can include a sensor section 212 disposed near fluid inlet. Sensor section 212 can include a plurality of sensors, which may be a number of different types of sensors. Such sensor types can include temperature sensors and pressure sensors. Other types of sensors that can measure properties of a fluid as the fluid flows by the sensors can be used. These types of sensors can include fiber optic based sensors, sensors to measure resistivity, sensors to measure density, sensors to measure capacitance, and other sensors capable of measuring properties of fluid phases. Tool 205 also includes a pump section 208 that functions to draw in fluid through probes 208-1 and 208-2. Following pump section 209 is another sensor section 214. Sensor section 209 can also include a plurality of sensors, which may be a number of different types of sensors. The components of tool 205 can be arranged and configured in a number of different combinations. These components may have fixed geometries and fixed distances. Alternatively, these components may be arranged such that there are a limited number of fixed geometries and fixed distances for a design of tool 205.

Determination of the phases and properties of the phases from data collected in sensor sections 212 and 214 can be conducted using analysis unit 220. Analysis unit 220 includes a processor 222, memory 224, and a communications interface 226. Signals from tool 205 received at communications interface 226 provide data to analysis unit 220, where analysis unit uses the data that exhibits the variation of the fluid phases at the sensors in sensor sections 212 and 214. Memory 224 can include algorithms and data to perform autocorrelation operations on the received data under control of processor 222. Processor 222 can be realized as one or more processors. Analysis unit 220 may be realized as an integrated unit with tool 205 operable downhole. Analysis unit 220 made be realized as a surface unit that communicates downhole over conventional communication vehicles for a drilling operation. Analysis unit 220 made be realized as a distributed unit with some components or portions of components locatable downhole and other components or portions of components locatable at the well surface.

Analysis unit 220 can operate relative to fluctuations in the fluid flow. If the measured signals at the sensors of sensor sections 212 and 214 are absence a sufficient degree of fluctuation to determine the phases and their properties, perturbation device 207 can be used to induce a perturbation into the fluid flow. Such a perturbation can be the generation of a pressure pulse to flow through one or more of the sensors.

Figure 3:
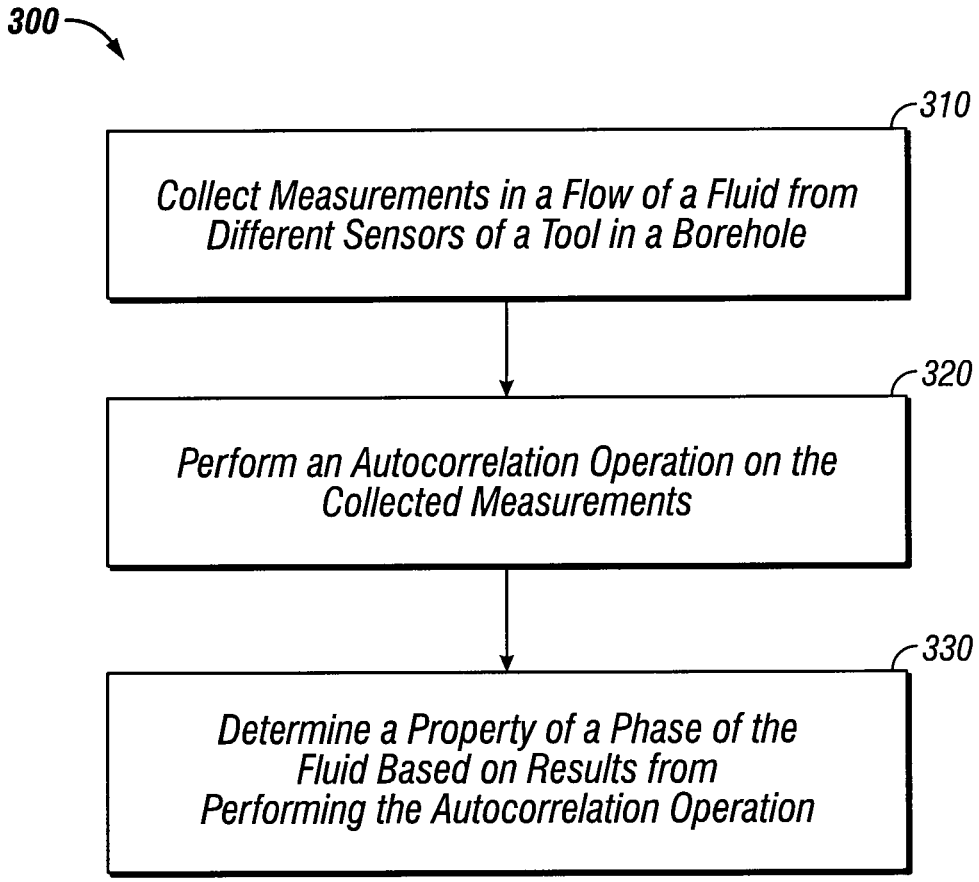
FIG. 3 shows features of an embodiment of a method of monitoring flow of phases of a fluid, according to various embodiments.

FIG. 3 shows features of an embodiment of a method 300 of monitoring flow of phases of a fluid. At 310, measurements in a flow of a fluid are collected from different sensors of a tool in a borehole. The sensors are dispersed along the tool such that the sensors in one or more combinations are sensitive to all phases of the fluid. At 320, an autocorrelation operation is performed on the collected measurements. Such autocorrelation operation can provide a factor of fluctuation per unit time that is matched to a respective phase of the fluid. The number of factors resulting from the autocorrelation operation can equal the number of phases of the fluid in the flow. Performing an autocorrelation operation on the collected measurements can be conducted using one or more of a time evolved factor analysis, a general autocorrelation, a multivariate curve resolution, or a histogram profiling. With the autocorrelation operation based on variations or fluctuations in the phases of the fluid over time, phases that are consistent over distance or mildly grading in composition and properties may be insensitive to the autocorrelation technique for determining flow rates of the phases. A perturbation upstream of the sensors can be injected relative to a phase of the fluid flowing, absent the perturbation, without variation at the sensors sensitive to this phase. A number of perturbations can be injected equal to or greater than the number of phases in the fluid. An iterative process can be conducted to provide sufficient fluctuations for the autocorrelation operation.

At 330, a property of a phase of the fluid is determined based on results from performing the autocorrelation operation. The determined properties of a phase of the fluid can include a volumetric flow rate of the phase, a mass flow rate of the phase, or other properties of the phase derivable from the volumetric flow rate and/or the mass flow rate. Such properties can be determined for each phase of the fluid. The fluid can be a single phase or a multiple phase fluid. A drilling operation may be directed based on determined properties from performing the autocorrelation operation on the collected measurements. Methods similar to or identical to method 300 can be conducted using tools and analysis units similar to or identical to tools and analysis units discussed herein.

In various embodiments, volumetric flow/mass flow measurement systems, including distributed sensors and an analysis unit to conduct autocorrelation operations on data collected from these sensors over distance and over time based on perturbation in the observed flow, provide a mechanism to determine flow of single and multiple phase fluids. This mechanism can provide determinations with a more stable average than conventional flow meters, which attempt to make use of a single point sensor to provide an all in one answer to determine flow of multiple phase fluids. Some of these conventional flow meters can often be complicated.

Typically, monitoring multiphase flow in a pump out operation is important, for example, in wireline sampling jobs. In various embodiments, a volumetric flow/mass flow measurement system, similar to or identical to tools and analysis units discussed herein, can provide measurements of such flow in straight forward manner. Using volumetric flow/mass flow measurement systems as discussed herein, bubble point and dew point may be directly determined, pump out rates may be maximized, and cleanup can be monitored for multiphase contamination such as water based drilling fluid in a normal petroleum sampling job. Using volumetric flow/mass flow measurement systems as discussed herein in production monitoring, the fraction of the total flow rate produced from a well that is due to water for flooding operations may be determined. Using volumetric flow/mass flow measurement systems as discussed herein in production monitoring, the fraction of the total flow rate produced from a well that is due to gas can be determined for enhanced oil recovery. Using volumetric flow/mass flow measurement systems as discussed herein in production monitoring, artificial lift or particulates content may be determined for sand loss control.

In various embodiments, a machine-readable storage medium having instructions stored thereon, which when executed by a processor, causes a machine to perform operations, the operations comprising: collecting measurements in a flow of a fluid from different sensors of a tool in a borehole, the sensors dispersed along the tool such that the sensors in one or more combinations are sensitive to all phases of the fluid, the phases being measureable phases; performing an autocorrelation operation on the collected measurements such that a factor of fluctuation per unit time is matched to each respective phase of the fluid; and determining a property of a phase of the fluid from performing the autocorrelation operation. The instructions can include instructions to determine a volumetric flow rate of the phase. The instructions can include instructions to determine a volumetric flow rate of each of the phases of a multiple phase fluid. The instructions can include instructions to perform the autocorrelation operation on the collected measurements using one or more of a time evolved factor analysis, general autocorrelation, multivariate curve resolution, or histogram profiling. The instructions can include instructions to determine a mass flow rate of the phase. The instructions can include instructions to inject a perturbation upstream of the sensors relative to a phase of the fluid flowing without variation at one or more of the sensors absent the perturbation. The instructions can include instructions to operate the tool with the fluid being a single phase fluid or a multiphase fluid. The machine-readable medium can also store parameters used in execution of the instructions and can also store results from execution of the instructions. The form of machine-readable medium is not limited to any one type of machine-readable medium, but can be any machine-readable medium. For example, a machine-readable medium can include a data storage medium that can be implemented in a housing disposed in a collar of a drill string, in a wireline configuration, and/or in a system control center.

Figure 4:
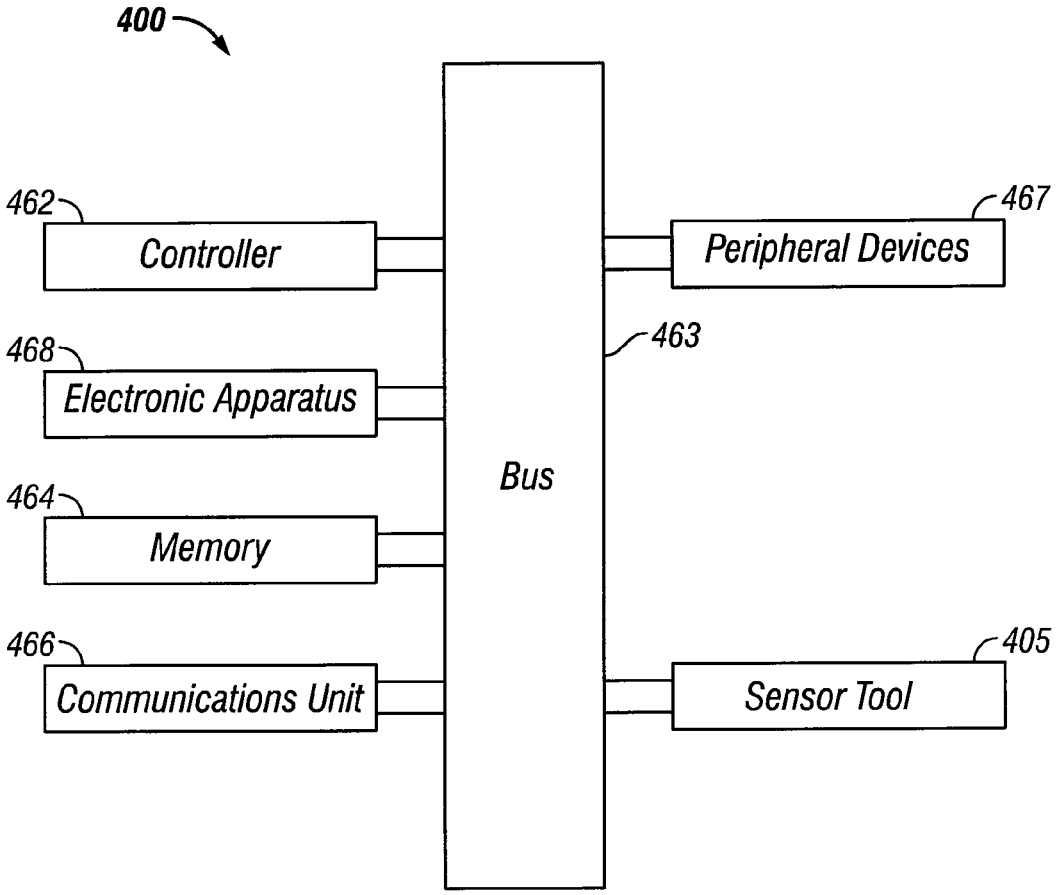
FIG. 4 depicts a block diagram of a system having a tool and an analysis unit to monitor flow of phases of a fluid, according to various embodiments.

FIG. 4 depicts a block diagram of features of an embodiment of a system 400 including a sensor tool 405 having a measuring tool and an analysis unit such that a phase of a single phase or a multiphase fluid can be monitored. The measuring tool includes a number of sensors dispersed along the tool, from which data can be collected for the analysis unit to conduct autocorrelations on the collected data to determine volumetric or mass flow rates of each of the phases of the fluid. Sensor 405 can be made robust to measure the fluid flow while downhole in a well. Sensor tool 405 can be realized in similar or identical manner to arrangements discussed herein.

System 400 can also include a controller 462, a memory 464, an electronic apparatus 468, and a communications unit 466. Controller 462, memory 464, and communications unit 466 can be arranged to operate sensor tool 405 to determine properties of the fluid being measured. Controller 462, memory 464, and electronic apparatus 468 can be realized to include control activation of individual sensors in sensor tool 405 and acquisition of data from the individual sensors in sensor tool 405 and to manage processing schemes in accordance with measurement procedures and signal processing as described herein. Communications unit 466 can include downhole communications in a drilling operation. Such downhole communications can include a telemetry system.

System 400 can also include a bus 463, where bus 463 provides electrical conductivity among the components of system 400. Bus 463 can include an address bus, a data bus, and a control bus, each independently configured. Bus 463 can also use common conductive lines for providing one or more of address, data, or control, the use of which can be regulated by controller 462. Bus 463 can be configured such that the components of system 400 are distributed. Such distribution can be arranged between downhole components such as individual sensors of sensor tool 405 and components that can be disposed on the surface. Alternatively, the components can be co-located such as on one or more collars of a drill string or on a wireline structure.

In various embodiments, peripheral devices 467 can include displays, additional storage memory, and/or other control devices that may operate in conjunction with controller 462 and/or memory 464. In an embodiment, controller 462 can be realized as one or more processors. Peripheral devices 467 can be arranged with a display that can be used with instructions stored in memory 464 to implement a user interface to manage the operation of sensor tool 405 and/or components distributed within system 400. Such a user interface can be operated in conjunction with communications unit 466 and bus 463. Various components of system 400 can be integrated with sensor tool 405 such that processing identical to or similar to the processing schemes discussed with respect to various embodiments herein can be performed downhole in the vicinity of the measurement.

Figure 5:
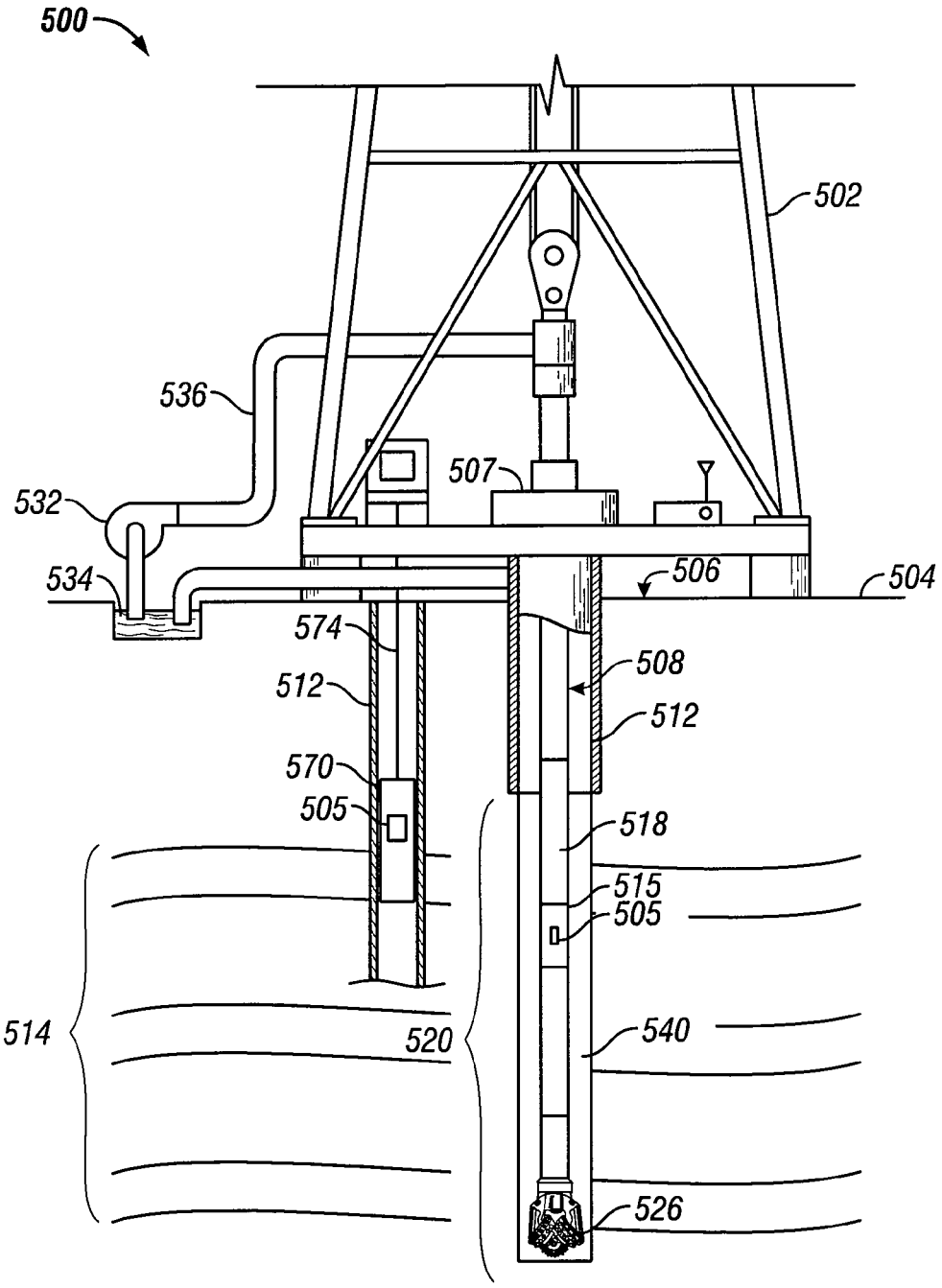
FIG. 5 depicts an embodiment of a system at a drilling site, according to various embodiments.

FIG. 5 depicts an embodiment of a system 500 at a drilling site, where system 500 includes a sensor apparatus 505 and electronics to monitor flow of single and multiple phase fluids. Sensor apparatus 505 can include a measuring tool and an analysis unit such that a phase of a single phase or a multiphase fluid can be monitored. The measuring tool includes a number of sensors dispersed along the tool, from which data can be collected for the analysis unit to conduct autocorrelations on the collected data to determine volumetric or mass flow rates of each of the phases of the fluid. Sensor apparatus 505 can be structured, fabricated, and operated in accordance with various embodiments as taught herein.

System 500 can include a drilling rig 502 located at a surface 504 of a well 506 and a string of drill pipes, that is, drill string 508, connected together so as to form a drilling string that is lowered through a rotary table 507 into a wellbore or borehole 512. The drilling rig 502 can provide support for drill string 508. The drill string 508 can operate to penetrate rotary table 507 for drilling a borehole 512 through subsurface formations 514. The drill string 508 can include drill pipe 518 and a bottom hole assembly 520 located at the lower portion of the drill pipe 518.

The bottom hole assembly 520 can include drill collar 515, sensor apparatus 505 attached to drill collar 515, and a drill bit 526. The drill bit 526 can operate to create a borehole 512 by penetrating the surface 504 and subsurface formations 514. Sensor apparatus 505 can be structured for an implementation in the borehole of a well as a MWD system such as a LWD system. The housing containing sensor apparatus 505 can include flow control components, such as a pump, to control collection of the fluid within sensor apparatus 505 for measurement of phases in the flow of the fluid. The housing containing sensor apparatus 505 can include electronics to activate sensors in sensor apparatus 505 and collect responses from the sensors in sensor apparatus 505. Such electronics can include an analysis unit to analyze signals sensed by the sensors in sensor apparatus 505 using autocorrelation operations and provide measurement results to the surface over a standard communication mechanism for operating a well. Alternatively, electronics can include a communications interface to provide signals sensed by sensor apparatus 505 to the surface over a standard communication mechanism for operating a well, where these sensed signals are analyzed using autocorrelation operations at an analysis unit at the surface.

In various embodiments, sensor apparatus 505 may be included in a tool body 570 coupled to a logging cable 574 such as, for example, for wireline applications. Tool body 570 housing sensor apparatus 505 can include flow control components, such as a pump, to control collection of fluid within sensor apparatus 505 for measurement of phases in the flow of the fluid. Tool body 570 containing sensor apparatus 505 can include electronics to activate sensors in sensor apparatus 505 and collect responses from the sensors in sensor apparatus 505. Such electronics can include an analysis unit to analyze signals sensed by sensors in sensor apparatus 505 using autocorrelation operations and provide measurement results to the surface over a standard communication mechanism for operating a well. Alternatively, electronics can include a communications interface to provide signals sensed by sensors of sensor apparatus 505 to the surface over a standard communication mechanism for operating a well, where these sensed signals are analyzed using autocorrelation operations at an analysis unit at the surface. Logging cable 574 may be realized as a wireline (multiple power and communication lines), a mono-cable (a single conductor), and/or a slick-line (no conductors for power or communications), or other appropriate structure for use in bore hole 512.

During drilling operations, the drill string 508 can be rotated by the rotary table 507. In addition to, or alternatively, the bottom hole assembly 520 can also be rotated by a motor (e.g., a mud motor) that is located downhole. The drill collars 515 can be used to add weight to the drill bit 526. The drill collars 515 also can stiffen the bottom hole assembly 520 to allow the bottom hole assembly 520 to transfer the added weight to the drill bit 526, and in turn, assist the drill bit 526 in penetrating the surface 504 and subsurface formations 514.

During drilling operations, a mud pump 532 can pump drilling fluid (sometimes known by those of skill in the art as "drilling mud") from a mud pit 534 through a hose 536 into the drill pipe 518 and down to the drill bit 526. The drilling fluid can flow out from the drill bit 526 and be returned to the surface 504 through an annular area 540 between the drill pipe 518 and the sides of the borehole 512. The drilling fluid may then be returned to the mud pit 534, where such fluid is filtered. In some embodiments, the drilling fluid can be used to cool the drill bit 526, as well as to provide lubrication for the drill bit 526 during drilling operations. Additionally, the drilling fluid may be used to remove subsurface formation 514 cuttings created by operating the drill bit 526.

In various embodiments, volumetric and/or mass flow of a single or multiple phase fluids can be monitored. Such a flow meter can be implemented for harsh environment use in oil fields or oil well settings. Methods for implementing a flow meter may be realized in a well bore for permanent installation, in a wireline reservoir tool string, or in a measurement while drilling sampling tool. Alternatively, methods of implementing the flow meter can be used in a surface mounted pipeline installation.

Although specific embodiments have been illustrated and described herein, it will be appreciated by those of ordinary skill in the art that any arrangement that is calculated to achieve the same purpose may be substituted for the specific embodiments shown. Various embodiments use permutations and/or combinations of embodiments described herein. It is to be understood that the above description is intended to be illustrative, and not restrictive, and that the phraseology or terminology employed herein is for the purpose of description. Combinations of the above embodiments and other embodiments will be apparent to those of skill in the art upon studying the above description

What is claimed is:

1. A method comprising:

collecting measurements in a flow of a fluid from different sensors of a tool in a borehole, the sensors dispersed along the tool such that the sensors in one or more combinations are sensitive to all phases of the fluid, the phases being measureable phases of compositional format of the fluid;

performing an autocorrelation operation on the collected measurements from the different sensors;

generating one or more factors that fluctuate across unit time using the autocorrelation operation;

matching a factor of fluctuation per unit time to each respective phase of the fluid; and determining a property of a phase of the fluid based on results from performing the autocorrelation operation.

2. The method of claim 1, wherein determining a property of a phase of the fluid includes determining a volumetric flow rate of the phase.

3. The method of claim 1, wherein the method includes determining a volumetric flow rate of each of the phases of the fluid.

4. The method of claim 1, wherein performing an autocorrelation operation on the collected measurements includes using one or more of a time evolved factor analysis, a general autocorrelation, a multivariate curve resolution, or a histogram profiling.

5. The method of claim 1, wherein determining a property of a phase of the fluid includes determining a mass flow rate of the phase.

6. The method of claim 1, wherein the method includes injecting, using a perturbation device, a perturbation upstream of the sensors relative to a first phase of the fluid to be measured by respective measuring sensors of the sensors, when the first phase is flowing without sufficient variation at the respective measuring sensors absent the perturbation by the perturbation device.

7. The method of claim 1, wherein the method includes directing a drilling operation based on determined properties from performing the autocorrelation operation on the collected measurements.

8. The method of claim 1, wherein the fluid is a multiple phase fluid.

9. A machine-readable storage medium having instructions stored thereon, which when executed by a processor, cause a machine to perform operations, the operations comprising:

collecting measurements in a flow of a fluid from different sensors of a tool in a borehole, the sensors dispersed along the tool such that the sensors in one or more combinations are sensitive to all phases of the fluid, the phases being measureable phases of compositional format of the fluid;

performing an autocorrelation operation on the collected measurements from the different sensors;

generating one or more factors that fluctuate across unit time using the autocorrelation operation;

matching a factor of fluctuation per unit time to each respective phase of the fluid; and determining a property of a phase of the fluid based on results from performing the autocorrelation operation.

10. The machine-readable storage medium of claim 9, wherein determining a property of a phase of the fluid includes determining a volumetric flow rate of the phase.

11. The machine-readable storage medium of claim 10, wherein the operations include determining a volumetric flow rate of each of the phases of the fluid.

12. The machine-readable storage medium of claim 9, wherein performing an autocorrelation operation on the collected measurements includes using one or more of a time evolved factor analysis, general autocorrelation, multivariate curve resolution, or histogram profiling.

13. The machine-readable storage medium of claim 9, wherein determining a property of a phase of the fluid includes determining a mass flow rate of the phase.

14. The machine-readable storage medium of claim 9, wherein the operations include injecting, using a perturbation device, a perturbation upstream of the sensors relative to a first phase of the fluid to be measured by respective measuring sensors of the sensors, when the first phase is flowing without sufficient variation at the respective measuring sensors absent the perturbation by the perturbation device.

15. The machine-readable storage medium of claim 9, wherein the fluid is a multiple phase fluid.

16. A system comprising:

a tool having a plurality of sensors dispersed along the tool, tool being operable in a borehole to collect measurements in a flow of a fluid from different sensors of the tool, the sensors operable in one or more combinations such that the sensors are sensitive to all phases of the fluid, the phases being measureable phases of compositional format of the fluid; and an analysis unit configured to perform an autocorrelation operation on the collected measurements from the different sensors such that one or more factors that fluctuate across unit time using the autocorrelation operation are generated and a factor of fluctuation per unit time is matched to each respective phase of the fluid.

17. The system of claim 16, wherein the analysis unit includes a processor and a machine-readable storage medium having instructions stored thereon, which when executed by the processor, cause the system to perform operations, the operations including:

determining a property of a phase of the fluid based on results from performing the autocorrelation operation, the property including one or more of volumetric flow rate of the phase or a mass flow rate of the phase; and performing the autocorrelation operation on the collected measurements includes using one or more of a time evolved factor analysis, a general autocorrelation, a multivariate curve resolution, or a histogram profiling.

18. The system of claim 16, wherein the tool and the analysis unit are operable in a wireline system or a logging-while-drilling system.

19. The system of claim 16, wherein the system includes a fluid stream perturbing device.

20. The system of claim 19, wherein the fluid stream perturbing device is disposed relative to the sensors such that the fluid stream perturbing device is operatively upstream relative to the flow of the fluid pass the sensors.

* * * * *